United States Patent [19]

Gaysert et al.

[11] Patent Number: 4,608,013

[45] Date of Patent: Aug. 26, 1986

[54] ULTRASONIC ATOMIZING BURNER

[75] Inventors: Gerhard Gaysert, Esslingen; Dieter Gotz, Kirchheim, both of Fed. Rep. of Germany

[73] Assignee: Die Firma J. Eberspächer, Fed. Rep. of Germany

[21] Appl. No.: 675,940

[22] Filed: Nov. 28, 1984

[30] Foreign Application Priority Data

Dec. 2, 1983 [DE] Fed. Rep. of Germany ..... 3343617

[51] Int. Cl.[4] ..... F23C 11/04

[52] U.S. Cl. ..... 431/1; 431/352; 126/91 A

[58] Field of Search ..... 431/1, 352, 264; 126/91 A

[56] References Cited

U.S. PATENT DOCUMENTS 4,062,343 12/1977 Spielman ..... 126/91 A 4,153,201 5/1979 Berger et al. ..... 431/1

*Primary Examiner*—Carroll B. Dority, Jr.

*Attorney, Agent, or Firm*—McGlew and Tuttle

[57] ABSTRACT

An ultrasonic atomizing burner for smaller heating apparatus particularly for mobile spaces, such as motor vehicles comprises an atomizer which has a fuel inlet and which is equipped with an atomizer discharge plate and a structure skirting the plate which defines a combustion air flow space for 1% at most of the combustion air amount. This structure includes a cylindrical combustion chamber having a forward discharge end with a flame baffle and with a heating gas outlet tube connected to the discharge end for the axial flow of the combustion gases. The combustion chamber has an ignition zone which is provided with wall bores for admitting primary air and it includes a spark plug in the ignition zone for igniting the combustion gases and the primary combustion air. The combustion chamber also has a burnout zone which is provided with wall slots for admitting secondary air downstream of the primary air.

16 Claims, 2 Drawing Figures

ULTRASONIC ATOMIZING BURNER

FIELD AND BACKGROUND OF THE INVENTION

This invention relates in general to burners and in particular to a new and useful ultrasonic atomizing burner which includes a combustion chamber having an ignition zone and a burnout zone.

The invention relates to an ultrasonic atomizing burner for smaller heating apparatus, particularly of mobile spaces, such as in motor vehicles, traveling living quarters, or home trailers, having a heating power of preferably less than 10 kw.

Quite a variety of requirements is imposed on such vehicle heating apparatus, depending on whether they are employed for an only short-time preheating of the coolant of the vehicle engine or of the interior of the vehicle, or for permanent heating to keep the coolant or the interior at a certain temperature; these apparatus are in most cases operated at full power in an on-off switching mode controlled by a thermostat.

From German Pat. No. 23 33 880 and German OS 24 50 801 there are known designs of ultrasonic atomizing burners which are derived from conventional pressure spray guns; they provide an axial supply of combustion air to a swirl producing vane ring, thus have large continuous cross-sectional areas for the air causing a low entrance speed at the combustion chamber. This, however, has basic drawbacks as will be explained hereinafter.

SUMMARY OF THE INVENTION

The invention is directed to an ultrasonic atomizing burner operating preferably at less than 10 kw and ensuring an optimum combustion, thus a small waste gas emission, as requiring only a small starting power.

In accordance with the invention, an ultrasonic atomizing burner for smaller heating apparatus particularly for use in motor vehicles comprises an atomizer which has a fuel inlet and is equipped with an atomizer discharge plate. The arrangement includes a construction which skirts the plate and defines a combustion air flow space for % at most of the combustion air amount with the remaining portion flowing radially into an annular space between an insert within the housing which is spaced from the interior wall thereof, passing through bores defined in the insert into an ignition zone of the combustion chamber in which the combustion air in a primary flow ignites with the fuel then flows axially in the combustion chamber to a space having slots in the insert for the passage of a secondary air tube.

The primary air streams passing through the bores in the combustion chamber, which, in accordance with the invention, are provided in the ignition zone, tear up the sluggish fuel mist stream leaving the atomizer plate, so that a satisfactory mixing is obtained. In this way, mixing and burnout conditions are created which hitherto could be obtained only with pressure guns, and these conditions are even improved. That is, in a pressure atomizer, the fuel particles are moved through the surrounding combustion air at a hight relative speed, which produces favorable conditions of mixing. In an ultrasonic atomizer, in contradistinction thereto, due to the atomization based on the capillary wave effect, the fuel particles leave the atomizing surface only at a relative low speed, so that the fuel mist is inert. The greatest part of the mixing energy must then be furnished by the combustion air. The high-voltage spark plug extending radially in the ignition zone is provided to ignite the mixture.

In the burnout zone, secondary air admitting slots having a length-to-width ratio of about 7 have proved best. The inwardly directed air streams provide for a further intense mixing.

By providing a tangential supply of air at the burner inlet, a spiral flow is produced in the combustion chamber, making the flow conditions in the combustion chamber symmetrical and forcing the fuel, by centrifugal force, to the radially remoter spark plug. Spark plugs with a small electrode length can then be employed, and the spark plug becomes less disturbing to the flow in the combustion chamber. Further, the spark plug is thermally less loaded and its life is extended. To obtain optimum conditions, the spin component must be selected correctly. With an excessive spin, the ignition conditions are worsened and the flame tends to be unstable. An advantageous embodiment provides that the surrounding air slots form an angle of preferably 60° with the longitudinal axis of the combustion chamber and that the combustion air is supplied tangentially into the annular spaces adjacent the combustion chamber. Intensity and direction of the spin are selected to turn the speed vector approximately perpendicularly to the lengthwise extension of the secondary air slots.

The combustion chamber is defined by an insert or member placed within the housing or jacket and it is surrounded by the jacket at spaced locations from its exterior. The intermediate space between the insert and the jacket is supplied with almost the total amount of combustion air which is then split into a primary air flow and a secondary air flow.

To reduce the thermal load on the atomizer which is partly made of a piezo-ceramic material and therefore sensitive to heat, the ignition zone may be equipped, with a thin-walled sheet metal insert which applies through embossments against the cylindrical and the front walls of the combustion chamber.

This insert has still another and a far more important function. The embossments used for spacing the insert apart from the surrounding wall of the combustion chamber form high heat conduction resistances. In addition, the convective transfer of heat to the outside is limited, since the proportion of the air flowing through the primary air bores to the total air amount is small. The result therefore is that the sheet metal insert reaches a substantially higher temperature than the surrounding combustion chamber walls. This may considerably reduce the soot deposition, or carbonization of these combustion chamber zones.

Another embodiment provides a somewhat differently designed sheet metal insert. The spacing between the insert and the combustion chamber wall is only 0.5 mm, due to correspondingly dimensioned embossments. While manufacturing the combustion chamber, the primary air bores are punched in a single operation through both sheets. The produced punching burr on the combustion chamber wall reduces the effective local gap through which the combustion air flows into an intermediate space. In consequence, the convective cooling of the insert by the air flowing through the intermediate space is less intense than in the embodiment described above. The tendency to carbonization in the ignition zone of the combustion chamber is thereby further reduced. Disadvantageous are the slightly higher costs of this embodiment.

In still another embodiment, an insert is replaced by an insulating coating applied on the combustion chamber walls. This may be a ceramic layer deposited by flame spraying, for example. An alternative is employing thin mats of fibrous ceramic material or metal tissue, usually serving as "wicks" in evaporation burners. Due to the sucking action and large surface of their fibrous structure, such mats have the advantage, in addition to their insulating effect, that they effectively disperse the fuel particles reaching the wall, thereby causing their complete combustion. The mats may be secured to the combustion chamber walls mechanically by means of fixing clips, or by a temperature resistant cement.

The entire combustion air skirts the atomizer within a cover casing provided on the front side of the combustion chamber jacket, so that the atomizer is intensely cooled.

The small air amount flowing around the atomizer plate after having skirting the atomizer stem, and being reduced by a throttling bore in the surrounding tube to 1% at most of the combustion air amount, has the sole purpose of dissipating heat and scavenging, thus of keeping free and clean athe locations needed for the atomization. The centric arrangement of the atomizer at the front wall of the combustion chamber results in a uniform mixing over the entire cross sectional area of the combustion chamber. The flabe baffle provided at the end of the chamber assists the recirculation of hot combustion gases, which is important to a satisfactory mixing.

Accordingly, it is an object of the invention to provide an improved ultrasonic atomizer burner.

A further object of the invention is to provide an ultrasonic atomizing burner which is simple in design, rugged in construction and economical to manufacture.

The various features of novelty which characterize the invention are pointed out with particularlity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
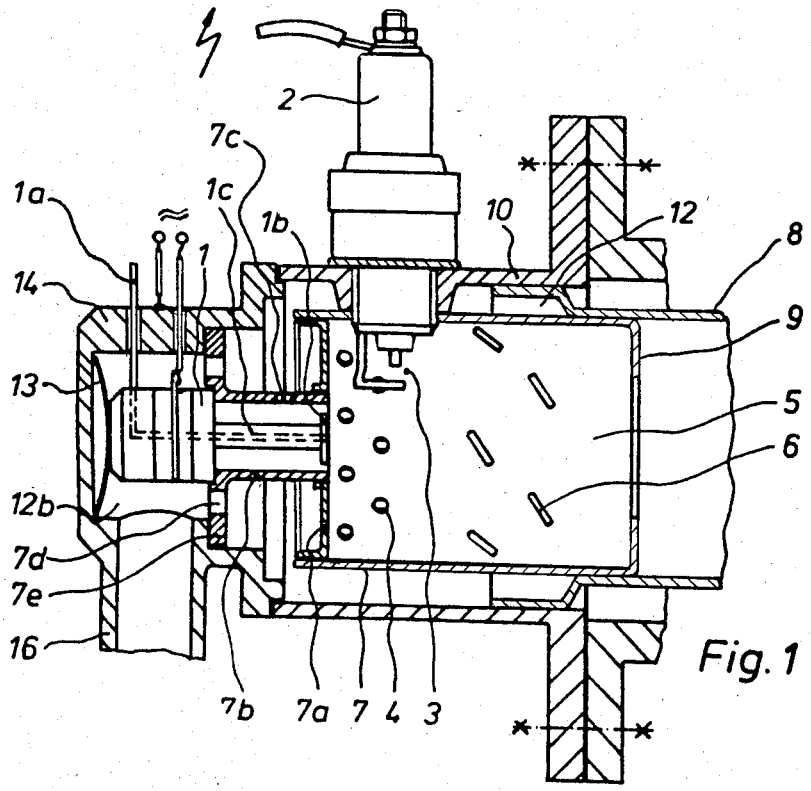
FIG. 1 is a longitudinal sectional view of an ultrasonic atomizing burner equipped with an axial flame tube, and constructed in accordance with the invention.

Referring to the drawings in particular the invention embodied therein comprises an ultrasonic atomizer burner particularly for small sized space heating such as in automobiles or moving devices and it comprises a housing 10 having a closed rear end or cover casing 14 with a combustion air inlet 16 for directing air into a combustion air space 12*b* at the rear end of the housing and for providing all the combustion air for the burner. A fuel atomizer 1 is arranged in the housing in the combustion air space adjacent the closed end and it has a stem portion 1*c* which extends forwardly in the housing and terminates in an atomizer discharge plate 1*b*.

Means are provided for directing fuel into the atomizer through a fuel inlet 1*a* and through a passage in a stem portion 1*c* for discharge through the atomizer plate 1*b*. A tubular member which may form a part of a cylindrical combustion chamber 7 surrounds the stem portion 1*c* and it includes a front wall or flange portion 7*a* extending radially from the atomizer 1 to the interior of the housing combustion air space 12*b*. This flange portion or cross wall 7*e* has an aperture 7*d* for the passage of combustion air and it includes a tubular portion 7*b* which extends around the stem portion 1*c* which defines a throttle bore 7*c* therethrough for the passage no more than 1% of the combustion air through a skirted area around the plate 1*b* and into an ignition zone 3 within the combustion chamber 7. The combustion chamber 7 is formed by a cylindrical member 7, which is spaced from the interior of the housing 10 and has radiating extending front wall 7*a* which extends from the periphery of the tubular portion 7*b* to the interior of the cylindrical combustion chamber 7. The combustion chamber is defined within the cylindrical combustion chamber forming member 7 forwardly of the atomizer plate 1*b*.

In accordance with the invention, means are provided for directing the combustion air into the housing around the atomizer 1 for flow through the aperture 7*d* around the tubular portion 7*b* of a primary combustion air stream with a small flow portion through the throttle bore 7*c* and into the space defined within the tubular length 7*b* and a skirted area around the throttling plate 1*b* into the combustion chamber ignition zone 3. The primary combustion air stream moves in the space between the cylindrical combustion chamber member 7 and the interior walls of the housing 10 and the primary stream passes through bores 4 into the ignition zone 3 where the fuel in the primary air combustion gases are ignited by a spark plug 2.

According to the figures, an ultrasonic atomizing burner 1 is centrically mounted on the front wall 7*a* of an unobstructed cylindrical combustion chamber 7 and provided with fuel supply inlet or connection 1*a* and with atomizer plate 1*b* which is skirted by a very small portion of the combustion air. On all sides, the atomizer is surrounded in spaced apart relationship by a cover casing 14 of a jacket 10 which surrounds on all sides the combustion chamber and is spaced apart therefrom. Almost the total amount of combustion air flows through the intermediate space 12*b* thus formed around the atomizer, to intensely cool the piezo-ceramic material, and through apertures 7*d* provided in a cross wall 7*e* within the cover casing, into the intermediate space 12 formed around the combustion chamber.

A combustion air inlet or connection 16 opens into cover casing 14 tangentially, to obtain an air inflow in this direction.

The combustion chamber, comprises an ignition zone 3 located adjacent front wall 7*a* and having its cylindrical wall provided with bores 4 for the admission of primary air from an annular intermediate space 12. Zone 3 accommodates a radially extending high voltage spark plug 2. A burnout zone 5 whose cylindrical wall is provided with slots 6 for the admission of secondary air from the annular intermediate space 12 forms a continuation of the combustion chamber. Secondary combustion air moves into the annular space 12 and then is discharged through slots 6 in a direction substantially perpendicular to the longitudinal axis of the burner. Slots 6 also extend obliquely at an angle to the longitudinal axis of the burner. The stem 1*c* of the atomizer is surrounded by a tube length 7*b* which is connected to the front wall 7*a* of the combustion chamber and provided with a throttling bore 7*c* for the air skirting the atomizer plate. Tube length 7*b* is integral with cross wall 7*e* against which the atomizer 1 is resiliently urged within cover casing 14 by a cup spring 13.

According to FIG. 1, a flame baffle 9 and, adjacent thereto, a heating gas outlet tube 8 producing an axial flow are provided at the other rear end of combustion chamber 7.

Figure 2:
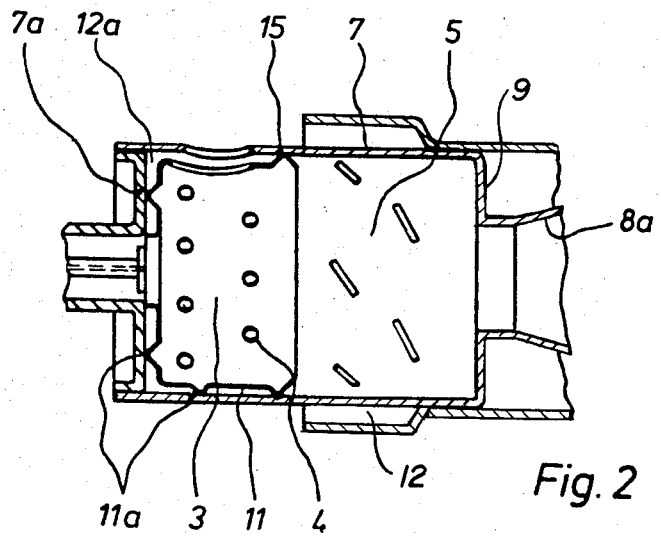
FIG. 2 is a partial longitudinal sectional view of such a burner in a modified design, with a sheet metal insert for the ignition zone, and an axial diffuser.

According to FIG. 2, ignition zone 3 is designed within an insert 11 so that an intermediate space about 1 to 2 mm wide is formed between two thin metal sheets. Both the circumferential and the front wall of insert 11 are formed with embossments 11*a* by which the insert applies against the combustion chamber cover. In the ignition zone, the cylindrical wall 7 of the combustion chamber is provided with apertures (not shown) for primary air. The primary air flows from the intermediate space 12*b* into the annular intermediate space 12*a* and therefrom through bores 4 into ignition zone 3, while secondary air passes, as in the embodiment of FIG. 1, from the annular intermediate space 12 directly through slots 6 into the burnout zone. At the end close to the atomizer, of insert 11, a circumferential embossment 15 is provided preventing primary air from escaping axially into the burnout zone. At the other end of the combustion chamber again a flame baffle 9 is provided which, however, is associated with a heating gas outlet diffuser 82, also causing an axial outflow.

This design may advantageously be modified by providing bores 4 which are punched simultaneously through combustion chamber 7 and insert 11 (not shown).

While specific embodiments of the invention have been shown and described in detail to illustrate the application of the principles of the invention, it wil be understood that the invention may be embodied otherwise without departing from such principles.

What is claimed is:

1. An ultrasonic atomizing burner for smaller heating apparatus particularly in mobile spaces, such as motor vehicles, comprising an atomizer having fuel inlet being equipped with an atomizer discharge plate, means skirting said plate defining a combustion air flow space for 1% at most of the combustion air amount, said skirting means including a cylindrical combustion chamber having forward discharge end with a flame baffle, a heating gas outlet tube connected to said discharge end for axial flow, said combustion chamber having an ignition zone which is provided with wall bores for admitting primary air, a radially extending high voltage spark plug in said combustion chamber, said combustion chamber having a burnout zone which is provided with wall slots for admitting secondary air downstream of said primary air.

2. An ultrasonic atomizing burner according to claim 1, wherein said combustion chamber is surrounded on all sides by a housing jacket spaced therefrom defining a small intermediate space which is supplied with substantially the total amount of combustion air which is then split into primary air and secondary air in said space.

3. An ultrasonic atomizing burner according to claim 1, including a thin walled insert within said housing forming said ignition zone and having air admittance bores, said insert including embossment portions which extend radially into engagement with the interior wall of said housing having at least one passage defined between said insert and the wall of said housing for the combustion air with the forward end forming a primary air space with the air flowing through bores of said insert into the combustion chamber and wherein the embossments prevent primary air from escaping axially into the secondary air space downstream of said primary air space.

4. An ultrasonic atomizing burner according to claim 3, wherein said combustion chamber housing has air admittance bores overlying said insert and said insert said bores therethrough in the primary air zone which align with said air admittance bores.

5. An ultrasonic atomizing burner according to claim 1, wherein the surface of said combustion chamber is lined completely with a thermal insulating layer which is interrupted, said chamber having admittance bores in the forward end thereof and an ignition zone at the location of the interruption of said insulation.

6. An ultrasonic atomizing burner according to claim 5, wherein said thermally insulating layer comprises a ceramic material applied to said combustion chamber wall.

7. An ultrasonic atomizing burner according to claim 5, wherein said thermally insulating layer is a thin mat of fibrous ceramic material.

8. An ultrasonic atomizing burner according to claim 5, wherein said thermally insulating layer is thin mat of metal tissue.

9. An ultrasonic atomizing burner according to claim 1, including spring means urging said atomizer away from said housing, said housing having a tubular member therein with a flange portion engaged with said housing.

10. An ultrasonic atomizing burner according to claim 1, wherein said outlet tube comprises a diffuser.

11. An ultrasonic atomizing burner particularly for small sized space heaters, comprising a housing having a closed rear end, a fuel atomizer in said housing adjacent said closed rear end and having a stem portion extending forwardly in said housing and terminating in an atomizer discharge plate, means for directing fuel into said atomizer for discharge out through said atomizer plate, a tubular member having a flange portion extending radially from said atomizer to the interior of said housing and with an aperture for the passage of combustion air and a tubular portion around said stem portion defining a throttle bore, a cylindrical member within said housing spaced from the interior of said housing and having a cylindrical wall extending axially within said housing and a radially extending front wall extending between the front end of said tubular member and said cylindrical wall and defining a combustion chamber forwardly of said atomizer plate, means for directing combustion air into said housing around said atomizer for flow through the aperture around said tubular portion for flow in a primary combustion air stream around said cylindrical member and the space between said cylindrical member and said housing wall with a small percentage flow through said throttling bore to provide a small combustion air percentage flow around said atomizer discharge plate and into said combustion chamber, said cylindrical member having bores therethrough in a rear portion thereof defining an ignition zone in said combustion chamber adjacent said atomizer plate, a high voltage spark plug extending radially into said ignition zone for igniting the combustion air with the primary combustion air flow and the small percentage flow around said atomizer plate, and a plurality of slots defined in said cylindrical member forwardly of said ignition zone permitting secondary combustion air flow from the space between said cylindrical member and the housing into said combustion chamber.

12. An ultrasonic atomizing burner according to claim 1, wherein said combustion chamber wall bores comprise rounded bores for the passage of primary air and said wall slots for the passage of secondary air are arranged obliquely at an angle to the longitudinal axis of the burner, and the housing around said combustion chamber defining an annular space between said combustion chamber and said housing which receives secondary air for discharge through said wall slots in a direction perpendicular to the longitudinal axis of the burner.

13. An ultrasonic atomizing burner according to claim 1, wherein said atomizer is surrounded at its rear by a cover casing spaced from said atomizer and defining an air space with said atomizer, a housing connected to said cover casing and disposed around said combustion chamber, said casing defining an annular space with said combustion chamber, said cover casing having a tangentially mounted connection for receiving combustion air, the total amount of combustion air for the burner being directed into said air space of said cover casing through said tangentially mounted connection.

14. An ultrasonic atomizing burner according to claim 1, wherein said combustion chamber has a front wall disposed around said atomizer discharge plate of said atomizer, said atomizer including a stem portion, a tubular member surrounding said stem portion, said tubular member having a throttling bore and being connected to said front wall of said combustion chamber.

15. An ultrasonic atomizing burner according to claim 11, wherein said slots defined in said cylindrical member extend obliquely to the axis of said combustion chamber, said housing defining an annular intermediate space around said cylindrical member, said means for directing combustion air being connected to said annular intermediate space for supplying secondary air for said slots, said annular intermediate space being disposed around said slots.

16. An ultrasonic atomizing burner according to claim 11, wherein said cylindrical member comprises an insert having embossed portions extending radially into engagement with the wall of said combustion chamber and maintaining said insert in spaced relationship with said combustion chamber, said housing defining an annular intermediate space with an exterior of said cylindrical member which communicates with said slots, said means for directing combustion air being connected to said annular intermediate space for supplying secondary combustion air to said annular intermediate space and through said slots.

* * * * *